United States Patent [19]

Knelson

[11] Patent Number: 4,608,040

[45] Date of Patent: Aug. 26, 1986

[54] CENTRIFUGAL SEPARATOR

[76] Inventor: Benjamin V. Knelson, 2707 Mountview Place, Burnaby, British Columbia, Canada, V3J 1E5

[21] Appl. No.: 595,814

[22] Filed: Apr. 2, 1984

Related U.S. Application Data

[63] Continuation-in-part of Ser. No. 510,509, Aug. 18, 1983, abandoned, which is a continuation-in-part of Ser. No. 479,677, Mar. 28, 1983, abandoned.

[51] Int. Cl.[4] ..... B04B 11/00

[52] U.S. Cl. ..... 494/27; 494/29; 494/80

[58] Field of Search ..... 494/43, 67, 68, 27, 494/28, 29, 85, 36; 210/360.1, 360.2, 380.1, 381, 382, 369, 378

[56] References Cited

U.S. PATENT DOCUMENTS

| | | | |
|---|---|---|---|
| 459,197 | 9/1891 | Bodge | 210/381 |
| 1,473,421 | 11/1923 | Eccleston | 494/29 |
| 1,594,501 | 8/1926 | Eccleston | 494/29 |
| 2,590,735 | 3/1952 | Svensjo | 494/80 |
| 2,599,619 | 6/1952 | Eckers | 494/20 |
| 3,963,175 | 6/1976 | Daubman | 494/90 |
| 4,170,420 | 10/1979 | Underwood | 366/165 |
| 4,361,480 | 11/1982 | Corbus | 494/80 |

FOREIGN PATENT DOCUMENTS

| | | |
|---|---|---|
| 22055 | 4/1936 | Australia . |
| 1111809 | 11/1981 | Canada . |

*Primary Examiner*—Robert W. Jenkins

*Attorney, Agent, or Firm*—Stanley G. Ade; Adrian D. Battison

[57] ABSTRACT

A centrifugal separator of the type comprising a bowl which is rotated about its axis and which has on the inner surface of the peripheral wall, a plurality of axially spaced radially extending rings and in between the rings, a plurality of openings through which water is injected from outside the bowl, has the openings arranged tangentially to the surface of the bowl and in a direction opposite to the direction of rotation to improve the fluidization of the material on the peripheral surface of the bowl. The openings are manufactured from a plurality of separate wall portions, each of which has projections stamped outwardly which are then drilled to provide tangentially extending holes. The wall portion is then rolled and assembled with a plurality of rings into a bowl where each wall portion is of greater diameter than the previous bowl portion closer to the base. An opening in the base lies under the lowermost ring and extends into a projection from the lowermost peripheral wall portion. A wear insert arrangement is positioned adjacent the open mouth of the bowl to receive material ejected from the end of the bowl.

19 Claims, 9 Drawing Figures

CENTRIFUGAL SEPARATOR

BACKGROUND OF THE INVENTION

This invention is a continuation-in-part of application Ser. No. 510.509, filed Aug. 18th, 1983 which is presently now abandoned and is in turn a continuation-in-part of application Ser. No. 479,677, filed Mar. 28th, 1983 which is not abandoned.

This invention relates to a centrifugal separator which can be used to extract heavy metals such as gold from a slurry containing the metal mixed with other materials.

There is disclosed in my Canadian Pat. No.: 1,111,809 a device of this general type which comprises a bowl having a base and a peripheral wall which is cylindrical and upstanding from the base. The peripheral wall has a plurality of axially spaced inwardly projecting rings arranged on its inner periphery and between each ring and the next adjacent ring is provided a plurality of openings in the peripheral wall. The bowl is encased in an outer wall which defines a chamber between the outer surface of the peripheral wall and the outer wall into which water can be injected under pressure so as to pass through the openings into the interior of the bowl and particularly between the rings.

The slurry or materials to be separated is deposited into the bowl at the base by a feed duct so the material is then thrown outwardly by rotation of the bowl to pass up the peripheral wall to an open mouth at the opposite end thereof to the base. During the passage over the peripheral wall, the materials are separated due to their different specific gravity with the lighter material discharging with the fluid or water out of the open mouth and the heavier materials remaining trapped on the peripheral wall between the rings.

This arrangement, while achieving substantial success in view of its considerable improvements from prior art arrangements, has a number of disadvantages.

Firstly, the separation which takes place on the peripheral wall is not optimized due to the relatively crude design of the bowl.

Secondly, the pressure required in the chamber around the peripheral wall in order to force the liquid or water through the openings into the bowl against the effects of centrifugal force is high and therefore the amount of water flow into the bowl is generally unsatisfactory.

Thirdly, after a batch of the material has been passed through the bowl, it is necessary to open the bowl and wash down the remaining materials from inside the bowl using a hose and separate water supply and this has been found to be somewhat onerous and disadvantageous.

Earlier devices of this type are also shown in Australian patent applications Nos. 22055/35 and 17487/34 (both by MacNicol). However, these early devices are extremely crude and certainly are less sufficient than the arrangement shown in my Canadian patent stated above.

SUMMARY OF THE INVENTION

It is one object of the present invention, therefore, to provide a centrifugal separator of this type which has an improved separating action.

It is a further object of the present invention to provide a separator of this type where the design of the bowl and particularly the openings enables the pressure within a chamber surrounding the peripheral wall to be reduced while still obtaining the required high level of fluid flow through the openings.

It is a yet further object of the invention to provide a separator of this type which is self-washing after completion of a batch of the material.

According to a first aspect of the invention there is provided an apparatus for centrifugally separating intermixed materials of different specific gravities comprising a centrifuge bowl having a base and a peripheral wall surrounding an axis passing through the base and generally upstanding from the base to an open mouth, a plurality of axially spaced inwardly projecting rings mounted on an inner surface of the peripheral wall and a plurality of openings extending through the peripheral wall from an outer surface to the inner surface thereof, the openings being arranged between each ring and the next adjacent ring and in spaced relation around the peripheral wall, means mounting the bowl for rotation about the axis, means for feeding the materials into the bowl such that during rotation of the bowl they flow over the peripheral wall for discharge from the open mouth and means for applying fluid to the outer surface of the bowl so as to pass through the openings and fluidize the materials between the rings, the openings passing through the peripheral wall in a direction inclined to an axial plane passing therethrough so as to tend to direct the fluid around the peripheral wall.

This arrangement has a number of advantages. Firstly, the openings which can be tangential or as close to the tangential direction as is practically possible, generate a flow of fluid within the bowl between the rings which swirls around the bowl so as to improve the fluidization of the material collecting between the rings. Thus, in prior devices it has been found that the material can compact between the openings and thus not properly fluidize and of course any compaction will reduce the efficiency of the separation. The present arrangement therefore allows the bed of material between the rings to be fully fluidized so that separation can take place throughout the whole of the bed and throughout all the height of the peripheral wall.

Furthermore, the tangential openings can be provided by projections stamped from the peripheral wall extending outwardly from the peripheral wall with an opening in the projection facing forwardly toward the direction of rotation. In this way, the opening tends to pump water from the enclosure surrounding the peripheral wall inwardly into the bowl and thus reduce the pressure necessary in the enclosure or surrounding jacket.

Furthermore, at the end of processing of a batch of the material when the bowl is stopped, the substantially tangential openings jet the fluid around the bowl and therefore act to wash the bowl without the necessity for further externally supplied water.

According to a second aspect of the invention, therefore, there is provided an apparatus for centrifugally separating intermixed materials of different specific gravities comprising a centrifuge bowl having a base and a peripheral wall surrounding an axis passing through the base and generally upstanding from the base to an open mouth, a plurality of axially spaced inwardly projecting rings mounted on an inner surface of the peripheral wall and a plurality of openings extending through the peripheral wall from an outer surface to the inner surface thereof, the openings being arranged between each ring and the next adjacent ring and in spaced relation around the peripheral wall, means mounting the bowl for rotation about the axis, means for feeding the materials into the bowl such that during rotation of the bowl they flow over the peripheral wall for discharge from the open mouth and means for applying fluid to the outer surface of the bowl so as to pass through the openings and fluidize the materials between the rings, wherein a first diameter of the peripheral wall adjacent said mouth is greater than a second diameter of the peripheral adjacent the base and wherein the ratio of total opening area to unit area at said first diameter is greater than at said second diameter.

It has surprisingly been found that in order to maximize the area of the peripheral wall which is used in the concentration or separation of the material, it is necessary to vary the proportion of opening area to unit area, depending upon the diameter of the bowl. It is previously known to provide a bowl which is of increasing diameter from the base to the open mouth since this improves the flow of the material from the inlet over the open mouth. However, it has recently been found that in such an arrangement, the varying centrifugal force obtained causes the balance between the in-flowing fluid through the openings and the centrifugal force of the material to be only satisfactory in a relatively small area of the height of the wall.

This problem has been overcome by varying the ratio of the opening area particularly by varying or increasing the number of holes of the same diameter per unit area so that there are more holes per unit area at the larger diameters of the bowl than at the smaller diameters.

Furthermore, the increase is not directly related to the diameter, but to a fraction of the diameter with the fraction in turn depending upon the largest diameter of the bowl.

According to a third aspect of the invention there is provided an apparatus for centrifugally separating intermixed materials of different specific gravities comprising a centrifuge bowl having a base and a peripheral wall surrounding an axis passing through the base and generally upstanding from the base to an open mouth, a plurality of axially spaced inwardly projecting rings mounted on an inner surface of the peripheral wall and a plurality of openings extending through the peripheral wall from an outer surface to the inner surface thereof, the openings being arranged between each ring and the next adjacent ring and in spaced relation around the peripheral wall, means mounting the bowl for rotation about the axis, means for feeding the materials into the bowl such that during rotation of the bowl they flow over the peripheral wall for discharge from the open mouth and means for applying fluid to the outer surface of the bowl so as to pass through the openings and fluidize the materials between the rings, the peripheral wall being formed from a plurality of wall portions each having a cylindrical form and each extending axially from one ring to the next adjacent ring, the diameters of the wall portions increasing from a wall portion adjacent the base to a wall portion adjacent the open mouth.

This arrangement provides a novel structure of bowl which instead of being formed integrally with curved or inclined peripheral wall, can be formed from a number of cylindrical wall portions, each rolled from a flat strip subsequent to the provision of the openings as previously defined.

Thus, the bowl can be simply and inexpensively manufactured and provides the preferred outwardly inclined wall.

According to a fourth aspect of the invention there is provided an apparatus for centrifugally separating intermixed materials of different specific gravities comprising a centrifuge bowl having a base and a peripheral wall surrounding an axis passing through the base and generally upstanding from the base to an open mouth, a plurality of axially spaced inwardly projecting rings mounted on an inner surface of the peripheral wall and a plurality of openings extending through the peripheral wall from an outer surface to the inner surface thereof, the openings being arranged between each ring and the next adjacent ring and in spaced relation around the peripheral wall, means mounting the bowl for rotation about the axis, means for feeding the materials into the bowl such that during rotation of the bowl they flow over the peripheral wall for discharge from the open mouth and a discharge opening through the base for discharging collected material from the bowl, the discharge opening lying wholly radially outwardly of an axial projection onto the base of the inner periphery of the ring next adjacent the base and having a radial dimension greater than the distance between said projection and the radially outer edge of the base so that the discharge opening extends into a recess in the peripheral wall.

It is one advantage of this aspect of the invention therefore that a discharge opening can be provided of a sufficiently large size to allow the proper and complete discharge of the material at the end of processing of a batch, particularly bearing in mind the self-washing aspect of the tangential openings as previously defined. At the same time the discharge opening is positioned at a location where it does not interfere with the normal operation of the processing where the material is fed into the bowl through a duct which discharges adjacent the base. Thus, the discharge opening is positioned beneath the first one of the rings.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
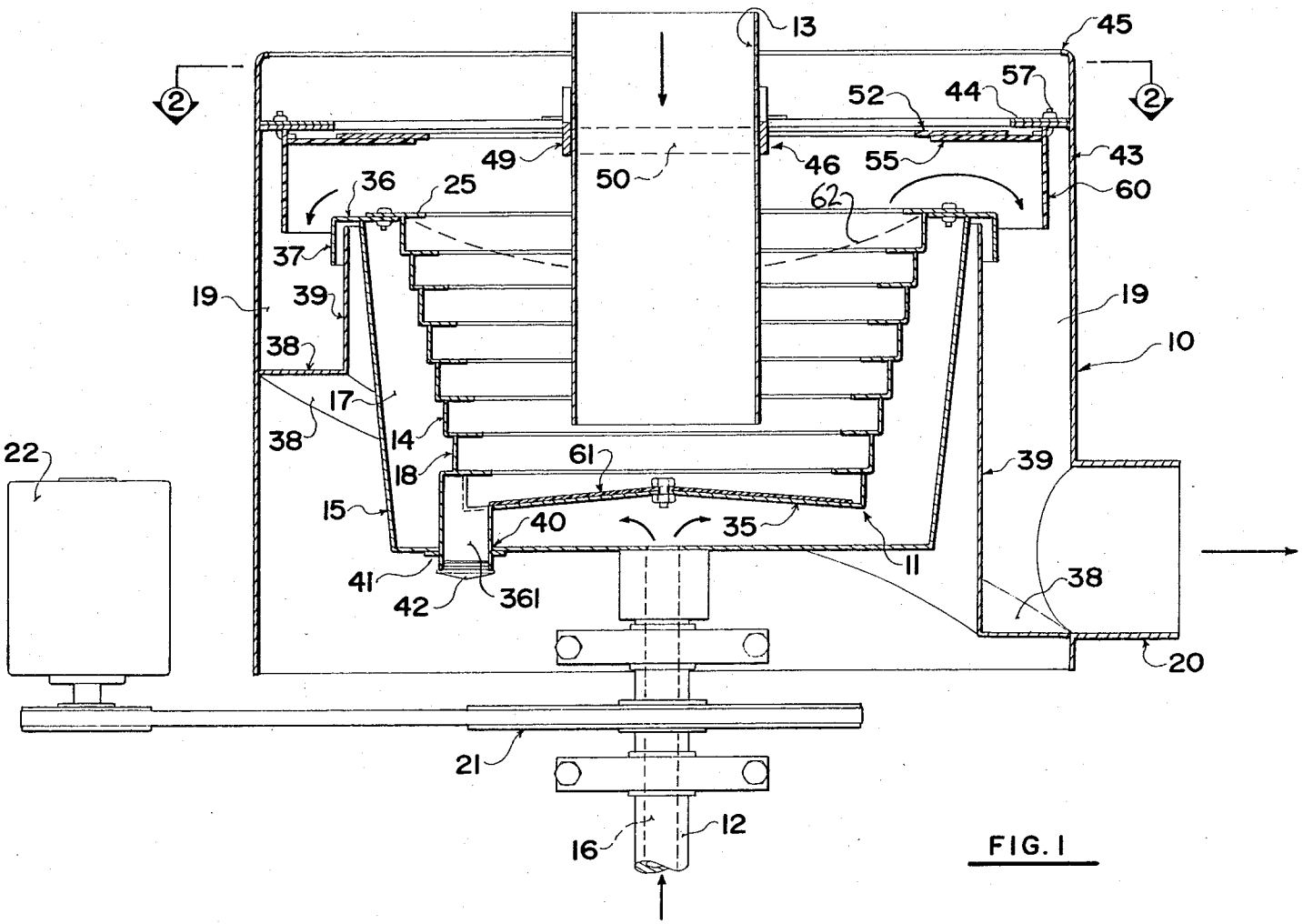
FIG. 1 is a cross sectional view through a centrifugal separator according to the invention, the cross section being shown at 1—1 in FIG. 2.

Turning firstly to FIG. 1, a centrifugal separator is shown in cross section and comprises generally, an outer casing 10 which supports a centrifuge bowl generally indicated at 11 for rotation on a shaft 12 about a central axis of the shaft and of the cylindrical container 10.

A feed duct 13 is mounted centrally of the container 10 for feeding material into the bowl with excess material escaping over the rim of the bowl into an annular channel 14 from which it runs to an outlet 15 at one side of the container 10.

The bowl 11 comprises an inner bowl assembly 14 and an outer bowl assembly 15 thus defining a chamber between the two parts of the bowl which surrounds the peripheral wall of the inner bowl assembly 14. A central duct is provided through the shaft 12 and indicated at 16 for supplying water under pressure to the enclosure indicated at 17 between the two bowl portions.

Openings 18 provided in the peripheral wall of the inner bowl portion 14 allow water to enter through the peripheral wall to join with the material flowing from the inlet 13 to the annular chamber 19. The shaft 12 is driven by a pulley 21 from an electric motor 22 so as to be rotated in a clockwise direction at a speed of the order of 400 rpm.

In use, material in slurry form containing fractions of high specific gravity, particularly gold, mixed with other material is fed into the duct 13 from a supply pipe and enters the bowl 11. The material is then washed over the peripheral wall of the bowl and escapes from the mouth into the annular duct 19. On the peripheral wall the separation takes place as will be explained in more detail hereinafter and the lighter fractions or tailings escape from the bowl through the outlet 20 to be discarded.

Figure 3:
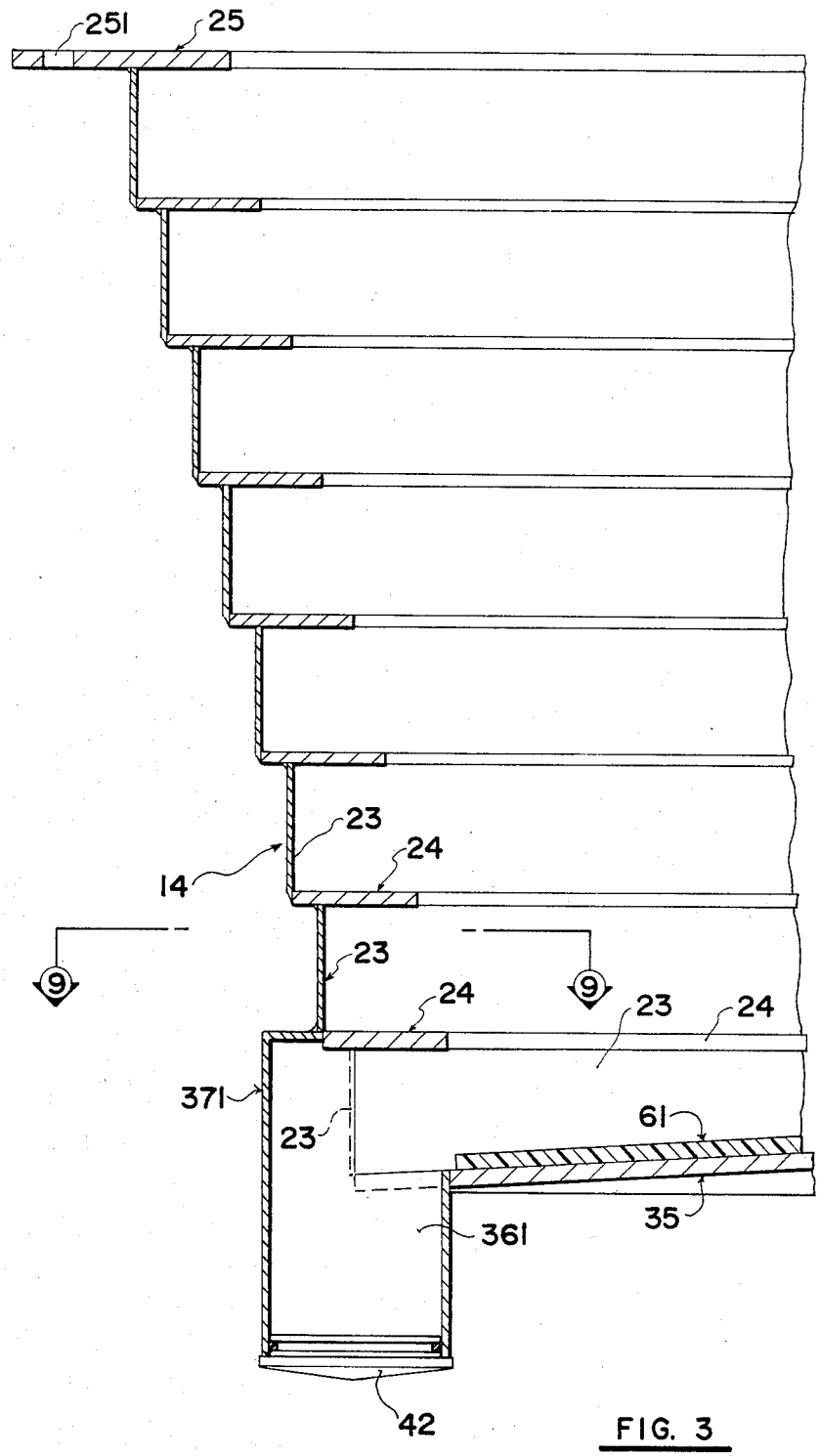
FIG. 3 is a fragmentary cross sectional view taken on the same cross section of FIG. 1 showing the wall of the bowl in enlarged view.
Figure 4:
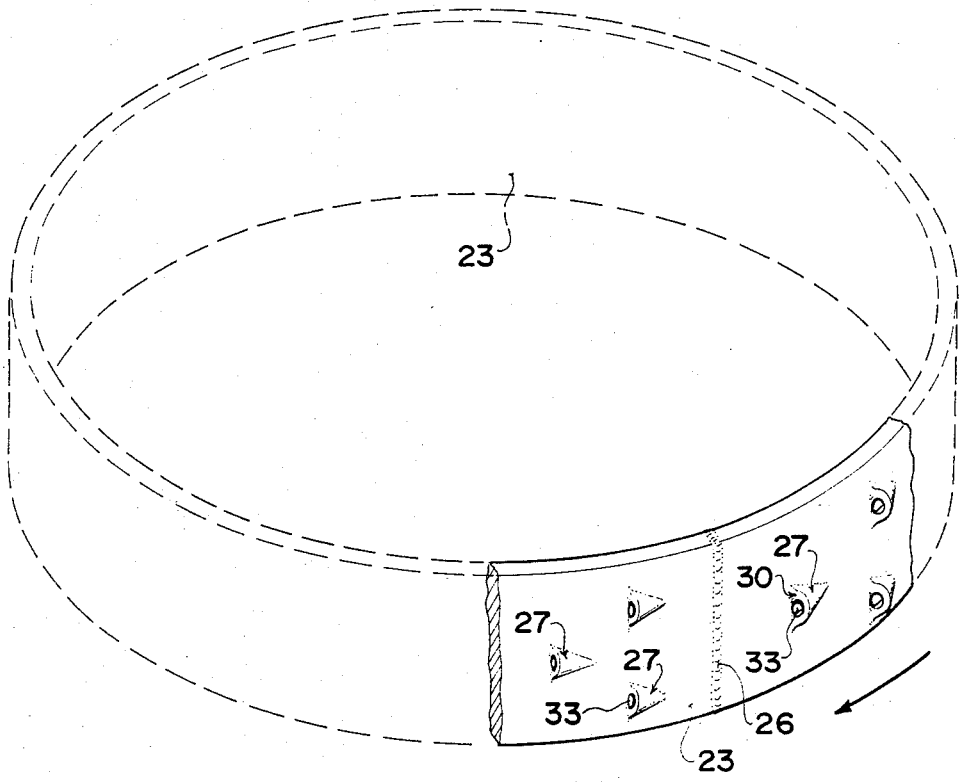
FIG. 4 is an isometric fragmentary view of a portion of the wall of the bowl.

Turning now to FIGS. 3 and 4, the structure of the inner bowl 14 is shown in detail. Specifically, the inner bowl 14 comprises a plurality of peripheral wall portions 23, each of which is cylindrical with the next outer portion being of larger diameter than the portion closer the base.

The wall portions 23 are spaced by rings 24 which again are stepped in increasing diameter from the base toward the open mouth terminating in an end ring 25. One of the wall portions is shown in FIG. 4 and it will be noted that this comprises a cylindrical portion which has been rolled from a flat plate and includes a welded seam line 26. In one example, the wall portion is formed from 14 gauge stainless steel and has a width of two inches and a diameter varying from twenty inches up to twenty-seven inches.

The wall portion is initially cut from a flat plate of stainless steel into the required dimension for forming the diameter concerned. At this stage, openings generally indicated at 27 are formed in the flat strip by the technique shown in FIGS. 5 and 6.

Figure 5:
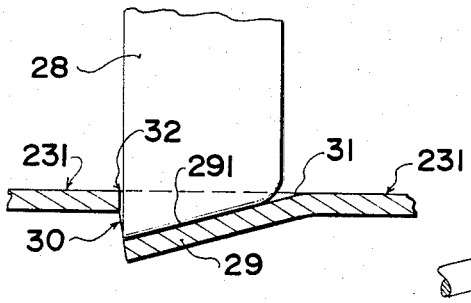
FIG. 5 is a cross sectional view along the lines 5—5 of FIG. 4 showing one opening in a first step of the manufacture thereof.

As shown in FIG. 5, the openings are formed by a first step in which a projection is punched into the flat strip by a forming tool 28. The projection is indicated at 29 and is punched so that it has a substantially flat front face 30 which extends substantially at right angles to the flat plate indicated at 231. The projection 29 from the front face 30 tapers both in width and height to a position spaced from the front face 30 and indicated at 31 at which it smoothly rejoins with the plate 231.

The front face 30 is arranged slightly inclined from the right angled direction in order that there is sufficient material of the wall left at this point so that it does not quite break away from the edge indicated at 32 of the plate 231. Thus, the front face 30 is in fact a fine web of material at the front of the tapered projection 29.

The depth of operation of the punch tool 28 is such that the distance of the inner surface of the projection 29 from the outer surface of the edge 32 is of the order of 1/16 inch. In addition, it will be noted from FIG. 4 that the front face 30 of the projection 29 is substantially circular having a diameter substantially equal to or slightly greater than twice the wall thickness plus 1/16 inch.

As a second step in the manufacturing process, a drill bit 32 is applied to the front face 30. The diameter of the drill bit is, in one example, 1/16 inch so that it just passes between the inner walls of the projection and the outer edge of the edge 32 at an angle to pass along the inner wall to the point 31. In this way, the opening in the front face 30 is formed by a perfectly circular hole 33 which faces substantially directly along the outer surface of the plate 231. The opening then communicates with the open topped channel formed on the inside of the plate 231 by the press tool 28, the bottom surface of which is indicated at 291 and lies at a shallow angle to the plate 231.

Figure 6:
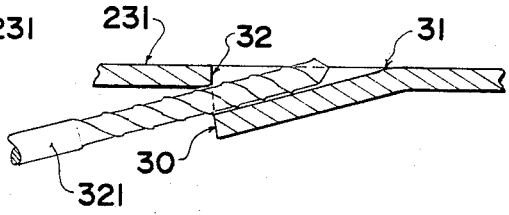
FIG. 6 is a view similar to FIG. 5 showing a second step in the course of manufacture of the openings of FIG. 4.

The stamping process shown in FIG. 5 and the drilling process shown in FIG. 6 are carried out as separate stages of the working of the plate 23 resulting in a plurality of holes or openings 27 as shown in FIG. 4 which are staggered, that is formed in three rows with the central row offset from the two outer rows to a middle point between the two outer rows.

After the flat plate has been stamped and drilled, it is then rolled by a conventional rolling process to the required diameter and the seam 26 welded to complete the cylindrical wall portion.

The rings 24 are separately manufactured from a suitable gauge metal by cutting from a flat sheet and it will be noted from FIG. 3 that the rings are of gradually increasing diameter but have the same radial extent which, in one example, is of the order of two inches. The end plate 25 has an inner periphery stepped to the same extent as the previous rings 24, but has a greater radial extent to provide sufficient material for an opening 251 which is one of a plurality of such openings around the periphery. In addition, the plate 25 is of thicker material than the rings 24.

Figure 7:
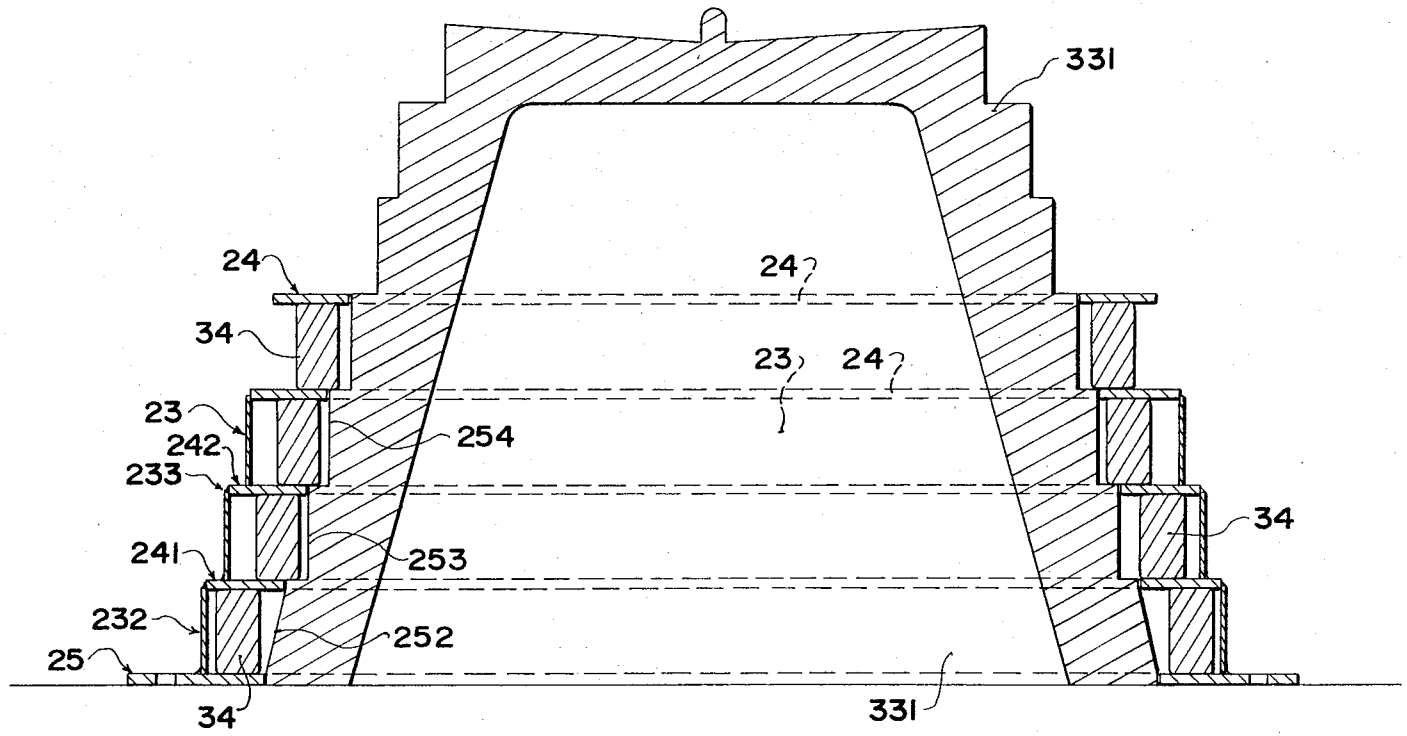
FIG. 7 is a cross sectional view through a jig used for the manufacture of the bowl showing the bowl partly assembled on the jig.

After the manufacture of all the rings and wall portions is complete, the bowl is assembled as shown in cross section in FIG. 7 on a jig 33. The jig 33 provides a series of stacked cylindrical formers on which the bowl is assembled. Thus, firstly the plate 25 is positioned around a first cylindrical portion indicated at 252 of the jig following which the outermost wall portion indicated at 232 is loosely positioned on the plate 25 and an annular spacer 34 is positioned within the wall portion 232. At this stage the first ring indicated at 241 is placed on the next former section 253 with its spacing from the plate 25 defined by the spacer 34 and its radial position defined by the former portion 253. The outer periphery of the ring 241 thus defines the position of the wall portion 232 and therefore the wall portion 232 can be tacked to both the ring 25 and the ring 241 to temporarily locate these in position.

In the next step a further wall portion 233 is loosely placed on the plate 241, a further spacer 35 is located in position and a further ring 242 is positioned on the next former section 254. The thus assembled pieces are again tacked in position and the process is repeated until a complete unit is tacked together and checked for proper positioning and is then welded by complete weld lines extending around between each wall portion and the adjacent rings.

Figure 9:
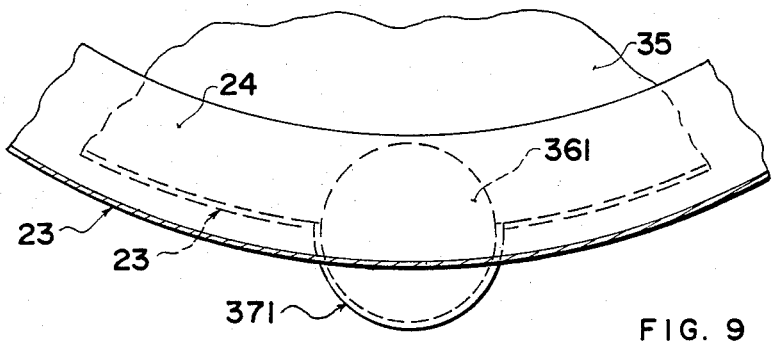
FIG. 9 is a cross sectional view along the lines 9—9 of FIG. 3.

Reverting to FIG. 3, it will be noted that the lowermost wall portion 23 is welded to a base 35 around the majority of the periphery thereof. However, at one position of the periphery of the base 35, an outlet 361 is positioned. The outlet 361 is circular in cross section with one tangent lying directly beneath a projection of the lowermost ring 24. The diameter of the opening 36 is however greater than the radial extent of the ring 24 so that it extends into a recess 371 provided in the lowermost peripheral wall portion 23. This is shown more clearly in FIG. 9.

Turning again to FIG. 1, the plate 25 of the inner drum 14 is bolted to a flange 36 of the outer bowl 15 so that the two bowls form an integral unit which corotates with the shaft 12. The flange 36 also includes a down-turned outer rim 37 which lies outside and substantially parallel to the outer wall of the outer bowl 15. The channel 19 is defined by a base wall 38 and an upstanding wall 39, the top edge of the upstanding wall extending into the space between the depending rim and the surface of the outer bowl 15 so as to provide effectively a seal to prevent material escaping from the bowl from splashing over the upstanding wall 39 into the interior of the housing.

It will be noted that the channel 19 has a highest point opposite the outlet 20 where the base 38 is attached to the side wall of the housing 10 at a point well above the outlet and then curves smoothly downwardly to the outlet 20 at the diametrically opposite position. The upstanding wall 39 is therefore of varying height depending upon the angular position relative to the base 38.

The opening 361 of the inner bowl 14 passes through an opening 40 in the bottom of the outer bowl so as to provide a mouth 41 and closure cap 42 on the underside of the outer bowl 15. The opening 361 is therefore normally closed during operation of the device.

Figure 2:
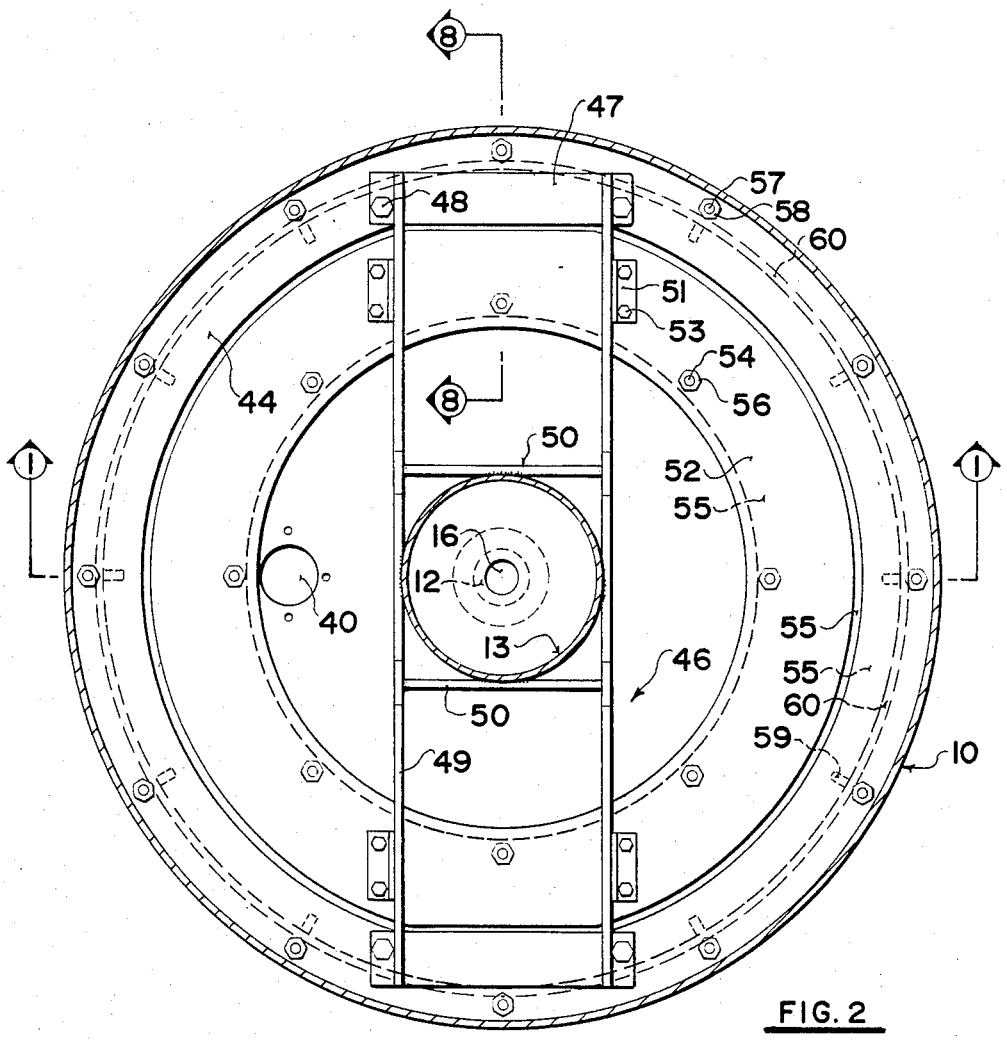
FIG. 2 is a cross sectional view along the lines 2—2 of FIG. 1.
Figure 8:
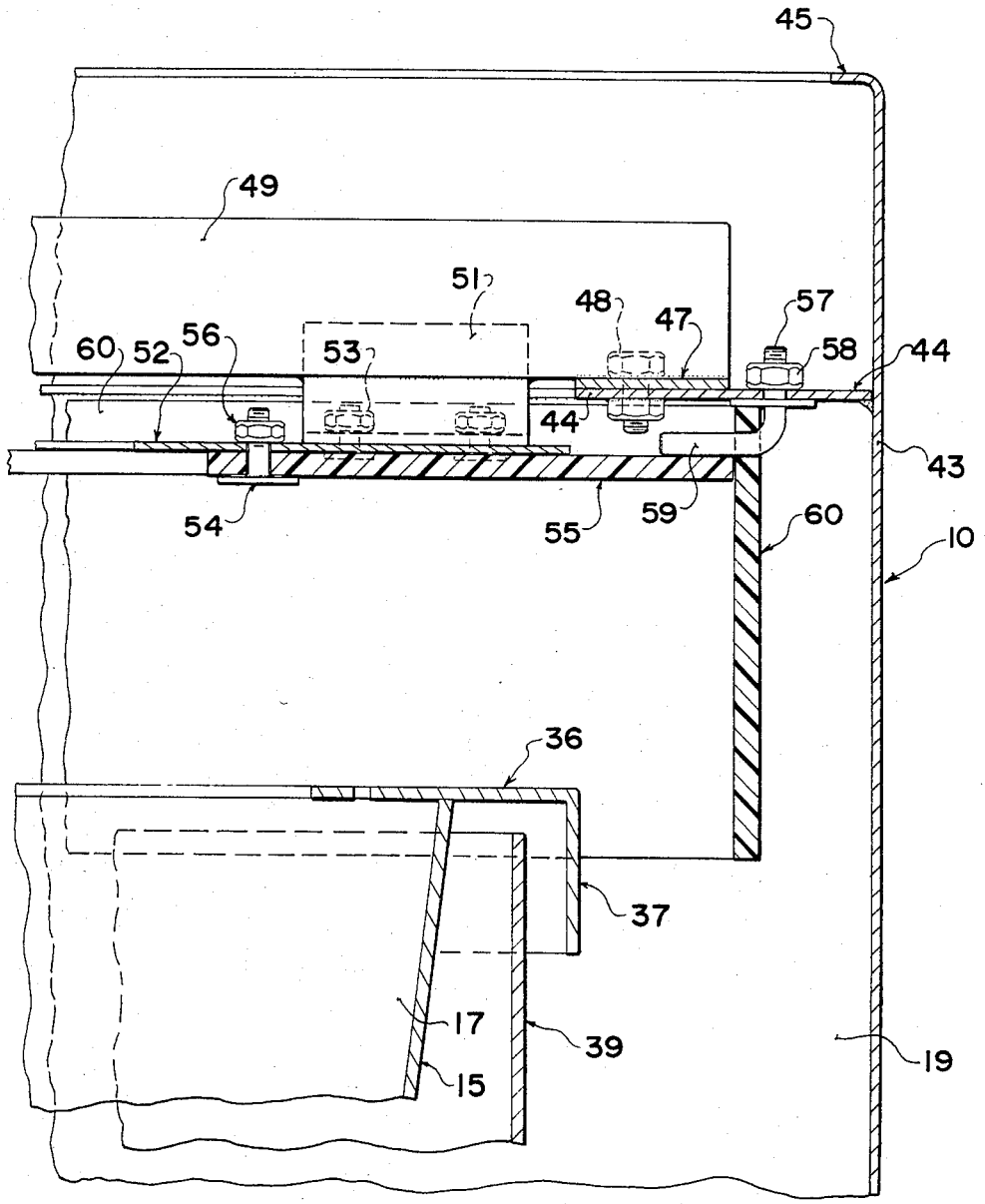
FIG. 8 is a cross sectional view on an enlarged scale along the lines 8—8 of FIG. 2.

Turning now to the upper structure of the device as shown best in FIGS. 1, 2 and 8, the outer cylindrical wall of the housing 10 is shown at 43 in FIG. 8 and includes an inwardly extending flange 44 at a position adjacent the top edge of the wall 43. At the top edge is provided an in-turned rim 45 parallel to the flange 44. The flange 44 supports and is bolted to a rectangular framework generally indicated at 46 which carries the central feed duct 13. The rectangular framework comprises a pair of end plates 47 bolted by bolts 48 to the flange 44, a pair of upstanding transverse beams 49 which extend across from one end plate 47 to the other and which support the duct 13 together with support beams 50 at right angles to the beams 49.

The beams 49 each carry a pair of spaced L-shaped brackets 51 arranged adjacent the ends thereof and these in turn support a ring 52 which has an outer diameter slightly less than the inner diameter of the flange 44 so that it can pass inside the inner periphery of the flange 44 to take up the position shown in FIG. 8. The ring 52 is bolted to the bracket 51 by a bolt 53 which also, by way of a flat head 54, supports a ring-shaped wear insert 55. The wear insert 55 is also supported relative to the ring 52 by further bolts 56 which extend around the ring 52 adjacent the inner periphery thereof.

A plurality of bolts 57 is arranged with the bolts attached around the periphery of the flange 44 adjacent the wall 43. One of the bolts is shown in FIG. 8 including a nut 58 with the bolt bent inwardly at right angles to provide a hanger portion 59. A curtain 60 of the same material as the wear resistant insert 55 is formed into a ring with a plurality of holes adjacent the upper edge so the curtain can be hung over the inwardly projecting hanger portions 59 and pushed outwardly to engage the shank of the bolt 57.

The ring 55 of the wear resistant material is then flexed into position as shown in FIG. 8 where its edge projects outwardly from the ring 52 to a position underlying the hanger 59 and engaging the inner surface of the ring 60. Thus, the portions 55 and 60 lie at right angles as shown in FIG. 8 with the outer periphery of the portion 55 protecting the hangers 59.

Reverting to FIG. 1, it will be noted that the bottom edge of the ring 60 lies beneath the upper edge of the bowls so the material escaping from the bowls when flung outwardly therefrom, engages either the curtain 60 or the outer edges of the ring 55. These wear resistant inserts are formed from a plastic material which has some flexibility and therefore is resistant to wear from the high speed water and grit which can be thrown out from the bowl. The unique design of the hangers and of the ring 55 which protects those hangers ensures that the material is prevented from engaging any metal parts or supports of the device and therefore wear is restricted to the wear inserts which are resistant and can be replaced after a time.

Turning again to FIG. 3, the wall portions 23 are manufactured with the openings 27 such that there are more openings per square inch or per unit area in the wall portion 23 of largest diameter than the wall portion 23 of smallest diameter. In fact, the number of holes per unit area in cases where the holes are all of the same diameter as preferred, or in other words the ratio of hole area to unit area is arranged to increase with the increase in diameter.

The number of holes in each of the wall portions can be calculated from the following formula:

$$\text{No. of holes} = k\pi d\left(1 + \left(\frac{d/d_1 - 1}{K}\right)\right)$$

where $d$ = diameter of wall portion $d_1$ = diameter of smallest wall portion $k$ = constant $K$ = a constant In one example using a 30 inch outside diameter of the bowl, k can be 1.45 and K can be 4. However, K can lie in the range two to four.

The bottom surface of the bowl or base 35 is slightly conical, that is it is formed by a very shallow cone and carries on the upper surface thereof a wear resistant layer 61 again of the flexible plastic material previously mentioned in relation to shields 55 and 60.

In operation, material is fed through the inlet duct 13 from a suitable piped supply. The material contains the high specific gravity fraction to be separated in combination with generally very much larger quantity of other materials such as sand, gravel and other impurities such as lower specific gravity metals. It is preferred that the material is filtered down to ¼ inch. The material is then fed in a slurry form which can contain ten gallons of water per minute for each cubic yard of material per hour.

The material entering vertically downwardly through the duct 13 contacts the base of the bowl and is thrown outwardly by the rotation of the bowl and the material already present in the bowl. The level of liquid and material which is obtained in a typical example is shown at 62 in FIG. 1.

The centrifugal action on the material acts to separate higher specific gravities toward the outer or peripheral surface of the inner bowl 14. This material tends to collect between the rings 24 while lighter material and water flows to the outer rim of the bowl to be thrown outwardly for collection at the outlet 20.

Without the presence of the openings 27 in the peripheral wall, the material would merely tend to pack between the rings and against the peripheral wall thus preventing any further separation of the packed material or of further material added to the bowl. It is necessary therefore to keep the material between the rings against the peripheral wall fluidized so that continual separation can take place. Thus, in each bed formed between an adjacent pair of rings, the material at the upper surface of the bed, that is closest to the centre of the bowl, must constantly exchange with material entering the bowl, dependent upon the specific gravity. In addition, material actually in the bed must also constantly exchange so that the higher specific gravity material moves outwardly eventually contact ing the peripheral wall itself.

This fluidization of the beds is achieved by injecting the water from the outer container 17 through the peripheral wall into the bed. Not only is the water injected into the bed but also it is injected with a component tangential to the bed and opposite to the direction of movement of the bowl so that the whole of the ring of material in between a pair of adjacent rings is constantly on the move relative to the bowl and is therefore constantly fluidized. The proportion of liquid entering the bowl through the openings is preferably of the order of 25% to 33%.

Using the proportion of holes as previously explained, the fluidization of the beds is such that substantially all of the beds act to properly separate the materials and therefore each can collect the highest specific gravity material. Without such variation in the holes, the balancing forces between the centrifugal force and the water injection providing fluidization of the bed are not retained at the required values to obtain the proper separation.

After the passage through the bowl of a suitable quantity of material, which in the example shown may be of the order of six cubic yards, the feed of material and water through the duct 13 is halted following which the bowl itself is halted. At this time the cap or plug 42 is removed from the opening 36 and a suitable container positioned beneath the opening to collect the material remaining within the bowl. The water injected into the inner bowl through the openings 27 tends to wash around the peripheral wall in view of the tangential direction in which it is injected thus again fluidizing the bed of material and washing it away from the lower ring adjacent that portion of the peripheral wall onto the base and from the base to the opening 36.

The diameter of the opening 36 is designed to accommodate the amount of water injected into the bowl so that the bowl empties rapidly and conveniently by the flow of water into the container for further separation in accordance with conventional techniques.

The device is then ready for a further batch of material with the plug 42 replaced and the bowl fully emptied of the materials separated from the previous batch.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. Apparatus for centrifugally separating intermixed materials of different specific gravities comprising a centrifuge bowl having a base and a peripheral wall surrounding an axis passing through the base and generally upstanding from the base to an open mouth, a plurality of axially spaced, inwardly projecting, peripherally extending projections mounted on an inner surface of the peripheral wall and a plurality of openings extending through the peripheral wall from an outer surface to the inner surface thereof, the openings being arranged between each projection and the next adjacent projection and in angularly spaced relation around the peripheral wall, means mounting the bowl for rotation about the axis, means for feeding the materials into the bowl such that during rotation of the bowl they flow over the peripheral wall for discharge from the open mouth, and means for applying fluid to the outer surface of the bowl so as to pass through the openings and fluidize the materials between the projections, the openings passing through the peripheral wall in a direction inclined to an axial plane passing therethrough so as to tend to direct the fluid around the peripheral wall.

2. Apparatus according to claim 1 wherein the openings are provided by projecting portions extending outwardly from the outer surface of the peripheral wall and wherein a mouth of the opening in the outer surface faces at least partly in the direction of rotation.

3. Apparatus according to claim 2 wherein the projecting portions are formed by distorted portions of the peripheral wall.

4. Apparatus according to claim 3 wherein the distortion is obtained by stamping.

5. Apparatus according to claim 2 wherein the projecting portions are tapered from the mouth of the opening in the direction of rotation.

6. Apparatus according to claim 2 wherein the mouth of the opening is circular.

7. Apparatus according to claim 6 wherein the mouth of the opening is obtained by drilling.

8. Apparatus according to claim 1 wherein the openings are formed by distorted portions of the peripheral wall obtained by stamping the peripheral wall with a former, the distorted portions having a substantially radial face from which each tapers in a substantially tangential direction to reduce the depth of the projection and each having a circular mouth facing in the substantially tangential direction and obtained by drilling through said substantially radial face in the substantially tangential direction.

9. Apparatus according to claim 1 wherein the openings are directed into the bowl with a component in a direction opposite to the direction of rotation thereof.

10. Apparatus for centrifugally separating intermixed materials of different specific gravities comprising a centrifuge bowl having a base and a peripheral wall surrounding an axis passing through the base and generally upstanding from the base to an open mouth, a plurality of axially spaced inwardly projecting, peripherally extending projections mounted on an inner surface of the peripheral wall and a plurality of openings extending through the peripheral wall from an outer surface to the inner surface thereof, the openings being arranged between each projection and the next adjacent projection and in angularly spaced relation around the peripheral wall, means mounting the bowl for rotation about the axis, means for feeding the materials into the bowl such that during rotation of the bowl they flow over the peripheral wall for discharge from the open mouth and means for applying fluid to the outer surface of the bowl so as to pass through the openings and fluidize the materials between the projections, wherein a first diameter of the peripheral wall adjacent said open mouth is greater than a second diameter of the peripheral wall adjacent the base and wherein the ratio of total opening area to unit area at said first diameter is greater than at said second diameter.

11. Apparatus according to claim 10 wherein the ratio is increased by a factor less than the increase in diameter.

12. Apparatus according to claim 10 wherein the ratios of the peripheral wall are arranged to vary relative to the diameter of the peripheral wall such that the concentration of material having a higher specific gravity occurs substantially over the hole of the peripheral wall.

13. Apparatus for centrifugally separating intermixed materials of different specific gravities comprising a centrifuge bowl having a base and a peripheral wall surrounding an axis passing through the base and generally upstanding from the base to an open mouth, a plurality of axially spaced inwardly projecting rings mounted on an inner surface of the peripheral wall and a plurality of openings extending through the peripheral wall from an outer surface to the inner surface thereof, the openings being arranged between each ring and the next adjacent ring and in spaced relation around the peripheral wall, means mounting the bowl for rotation about the axis, means for feeding the materials into the bowl such that during rotation of the bowl they flow over the peripheral wall for discharge from the open mouth and means for applying fluid to the outer surface of the bowl so as to pass through the openings and fluidize the materials between the rings, the peripheral wall being formed from a plurality of wall portions each having a cylindrical form and each extending axially from one ring to the next adjacent ring, the diameters of the wall portions increasing from a wall portion adjacent the base to a wall portion adjacent the open mouth.

14. Apparatus according to claim 13 wherein each wall portion is attached at one axial extent to the outer periphery of one adjacent ring and at the other axial extent to an intermediate diameter of the other adjacent ring.

15. Apparatus according to claim 13 wherein the wall portions are formed into said cylindrical form by rolling from a flat strip.

16. Apparatus according to claim 15 wherein the openings are formed in said flat strip prior to rolling thereof.

17. Apparatus according to claim 13 wherein the rings are planar and of the same radial extent from an outer periphery thereof to an inner periphery thereof and wherein the diameters of the outer periphery of the rings increases from a ring adjacent the base to a ring adjacent the open mouth.

18. Apparatus according to claim 13 formed by welding each separate wall portion to the separate rings at the axial extents of said wall portion whereby the wall portions and rings form an integral bowl by said welding.

19. Apparatus for centrifugally separating intermixed materials of different specific gravities comprising a centrifuge bowl having a base and a peripheral wall surrounding an axis passing through the base and generally upstanding from the base to an open mouth, a plurality of axially spaced inwardly projecting rings mounted on an inner surface of the peripheral wall and a plurality of openings extending through the peripheral wall from an outer surface to the inner surface thereof, the openings being arranged between each ring and the next adjacent ring and in spaced relation around the peripheral wall, means mounting the bowl for rotation about the axis, means for feeding the materials into the bowl such that during rotation of the bowl they flow over the peripheral wall for discharge from the open mouth and a discharge opening through the base for discharging collected material from the bowl, the discharge opening lying wholly radially outwardly of an axial projection onto the base of the inner periphery of the ring next adjacent the base and having a radial dimension greater than the distance between said projection and the radially outer edge of the base so that the discharge opening extends into a recess in the peripheral wall.

* * * * *